US008205598B2

(12) United States Patent
Siuchta et al.

(10) Patent No.: US 8,205,598 B2
(45) Date of Patent: Jun. 26, 2012

(54) FUEL INJECTOR NOZZLE

(75) Inventors: Grzegorz Siuchta, Des Plaines, IL (US); Rakesh Malhotra, Aurora, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 321 days.

(21) Appl. No.: 12/702,089

(22) Filed: Feb. 8, 2010

(65) Prior Publication Data

US 2011/0192375 A1 Aug. 11, 2011

(51) Int. Cl.
*F02M 55/02* (2006.01)
*F02M 55/00* (2006.01)

(52) U.S. Cl. ..... 123/468; 123/469

(58) Field of Classification Search ..... 123/445, 123/467, 468, 469, 470; 239/533.2, 533.12, 239/548, 88

See application file for complete search history.

(56) References Cited

U.S. PATENT DOCUMENTS 2,143,052 A * 1/1939 Chandler ..... 123/450
4,763,481 A * 8/1988 Cannon ..... 60/737
5,577,386 A * 11/1996 Alary et al. ..... 60/742
5,713,205 A * 2/1998 Sciocchetti et al. ..... 60/740
6,131,828 A * 10/2000 Buckley et al. ..... 239/533.2
6,851,412 B2 * 2/2005 Jay ..... 123/456
6,868,831 B2 3/2005 Lei
6,978,747 B2 12/2005 Yager
7,004,123 B2 2/2006 de Ojeda
7,347,176 B1 3/2008 Estacio
2002/0053340 A1 5/2002 Lei
2002/0109014 A1 * 8/2002 Augustin ..... 239/88
2004/0194744 A1 10/2004 Yager

OTHER PUBLICATIONS

International Search Report for PCT US2011/023928 dated Apr. 6, 2011.
Written Opinion of the International Search Report for PCT US2011/023928 dated Apr. 6, 2011.

* cited by examiner

*Primary Examiner* — Mahmoud Gimie
(74) *Attorney, Agent, or Firm* — Mark C. Bach; Jeffrey P. Calfa

(57) ABSTRACT

A nozzle (10) for a fuel injector of an engine includes a generally cylindrical housing (16) having a valve passage (28) disposed generally longitudinally along the centerline C of the housing and extending from a top surface (12) of the housing. An annular groove (40) is disposed in the top surface (12) of the housing (16) and is concentrically disposed about the valve passage (28). A plurality of high pressure passages (44) are disposed in the annular groove (40). The high pressure passages (44) fluidly communicate with the valve passage at a junction chamber (34). A nozzle tip (24) is in fluid communication with the junction chamber (34).

20 Claims, 2 Drawing Sheets

FUEL INJECTOR NOZZLE

BACKGROUND

Embodiments described herein relate to fuel injectors for engines of vehicles. More specifically, embodiments described herein relate to nozzles for fuel injectors of vehicle engines.

The conventional combustion process in a diesel engine is initiated by the injection of fuel into a combustion chamber containing compressed air. The fuel is directly injected into the combustion chamber by a fuel injector having a perforated nozzle tip extending into the combustion chamber. The nozzle tip may extend slightly into the combustion chamber from a wall of the chamber. Typically, the nozzle tip is located opposite a reciprocating piston of the combustion chamber. The nozzle tip has a plurality of orifices from which fuel is extruded into the combustion chamber.

Fuel injectors break up a stream of injected fuel into small liquid particles that are suitable for rapid and complete combustion, called fuel atomization. The diesel fuel is typically injected at high pressures out through the plurality of orifice holes that are located at the nozzle tip. The resultant spray pattern is separate and distinct plumes of atomized fuel droplets. The fuel droplets evaporate and mix with the combustion air for a given temperature, pressure and air/fuel ratio.

To operate the nozzle, pressure from the delivery of fuel from the injector acts upon a valve until a spring preload on the valve is overcome. The valve rapidly opens and fuel is sprayed from the nozzle tip until the pressure falls and the spring loading returns the valve to its seating.

Thus, the fuel injector nozzle must deliver the fuel at a sufficiently high injection pressure to the combustion chamber for atomization. Generally, the higher the injection pressure, the greater the improvement in fuel economy and the greater the reduction in emissions. Conventional injector nozzles may fail when they are unable to withstand the high pressures built up within the nozzle, which is required for fuel delivery under high pressure. Currently, the conventional nozzle pressures are limited to a maximum of about 2500 bar before failure of the nozzle can occur.

SUMMARY OF THE INVENTION

A nozzle for a fuel injector of an engine includes a generally cylindrical housing having a valve passage disposed generally longitudinally along the centerline of the housing and extending from a top surface of the housing. An annular groove is disposed in the top surface of the housing and is concentrically disposed about the valve passage. A plurality of high pressure passages are disposed in the annular groove. The high pressure passages fluidly communicate with the valve passage at a junction chamber. A nozzle tip is in fluid communication with the junction chamber.

DETAILED DESCRIPTION

Figure 1:
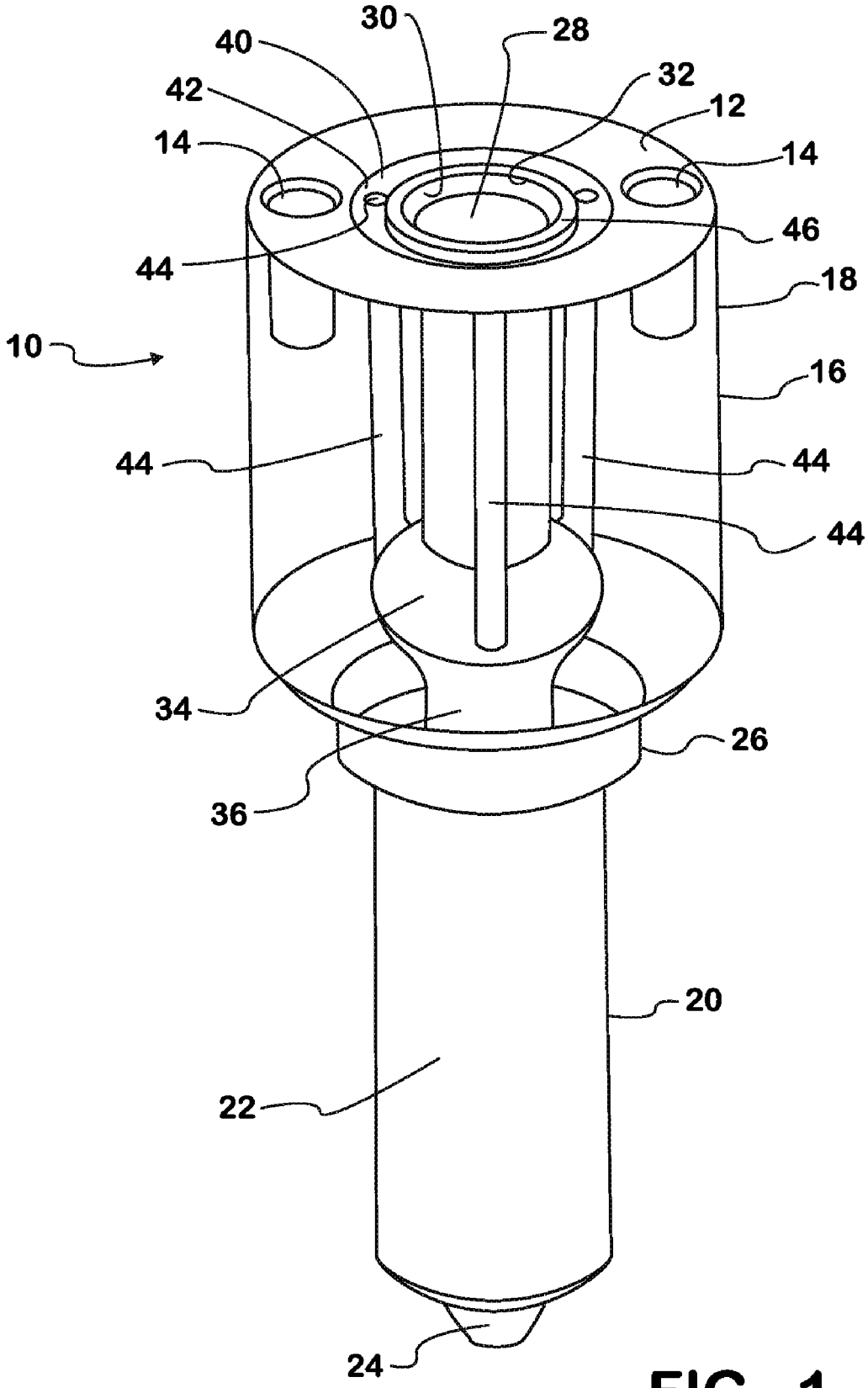
FIG. 1 is a perspective view of a fuel injector nozzle having multiple high pressure passages.
Figure 2:
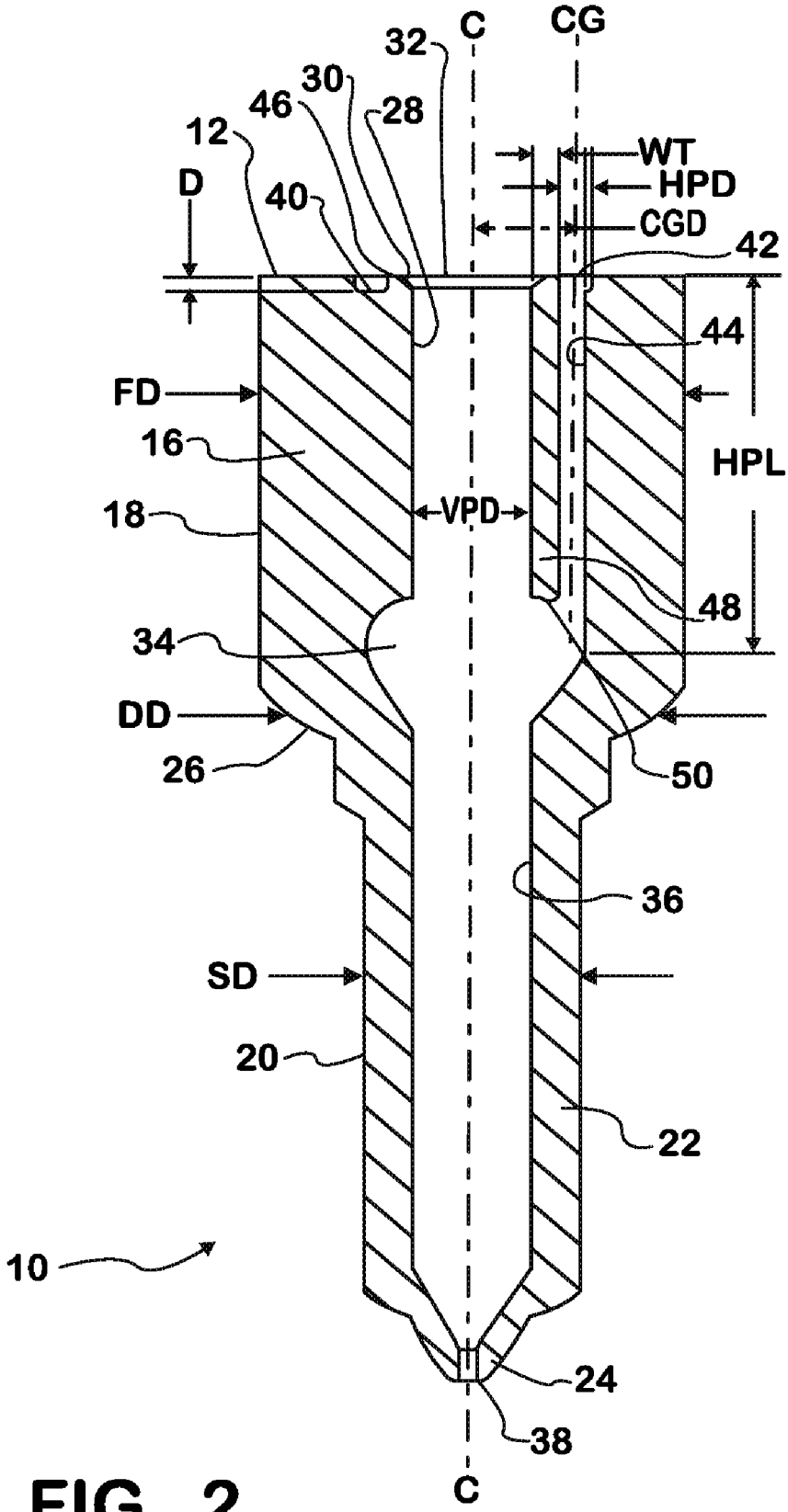
FIG. 2 is a section view of the fuel injector nozzle taken along the longitudinal axis of the injector nozzle.

Referring now to FIGS. 1-2, a fuel injector nozzle for an engine is indicated generally at 10 and is configured to be attached to a spring cage (not shown) of a fuel injector (not shown) for receiving fuel from the injector. The spring cage (not shown) is attached at a top surface 12 of the nozzle 10 and may be secured with fasteners, for example a dowel (not shown), received at receiving holes 14. In the injector nozzle 10, there are two receiving holes 14 located about 180-degrees apart.

The fuel injector nozzle 10 has a housing 16 with a first portion 18 that is generally cylindrical and has a first diameter FD, and a second portion 20 that is generally cylindrical and has a second diameter SD. The second portion 20 may be generally pintle-shaped, with an elongated shaft 22 and a nozzle tip 24. The first diameter FD is larger than the second diameter SD of the shaft 22.

A third portion 26 is disposed between the first portion 18 and the second portion 20 and has a decreasing diameter DD in the direction from the first portion 18 to the second portion 20. The first portion 18 extends from the top surface 12 to the third portion 26, and the second portion 20 extends from the third portion 26 to the nozzle tip 24. It is possible that the housing 16 may be integrally formed or formed in multiple components.

A valve passage 28 extends generally longitudinally along the centerline C of the housing 16 of the fuel injector nozzle 10, and extends from the top surface 12 through the first portion 18 of the housing. The valve passage 28 may have a diameter VPD of about 4 mm, however other diameters are possible. A valve, for example a needle valve (not shown), is housed in the valve passage 28. A chamfered entry formation 30 may be disposed at an inlet 32 of the valve passage for ease of assembly of the injector nozzle 10 with the needle valve (not shown) and the spring cage (not shown).

The valve passage 28 is in fluid communication with a junction chamber 34, which is a kidney or bulbous-shaped volume of increased diameter relative to the valve passage. The junction chamber 34 forms part of an interior passage 36 of the housing. The interior passage 36 is disposed generally longitudinally along the centerline C of the injector nozzle 10 and extends generally longitudinally from the junction chamber 34 within the shaft 22 to the nozzle tip 24.

Referring now to FIG. 2, at the nozzle tip 24, the interior passage 36 has decreased diameter. A plurality of orifice holes 38 are located at the nozzle tip 24 for emitting the atomized fuel under high pressure from the nozzle tip. The orifice holes 38 are typically small, on the order of about 150 microns, however other sizes are possible, and due to such small size, are not drawn to scale in FIG. 2.

Disposed annularly and concentrically around the inlet 32 of the valve passage 28 is a groove 40 in the top surface 12 of the injector nozzle 10. The depth D of the groove 40 may be about 0.5 mm into the top surface 12 towards the nozzle tip 24, and the groove is located in the top surface such that the centerline of the groove CG may have a radial distance CGD of about 3.5 mm from the centerline C of the injector nozzle 10. It is possible that the depth D of the groove and the radial distance CGD can have other dimensions.

Disposed within the annular groove 40 are inlets 42 to a plurality of high pressure passages 44. The width of the annular groove 40 and the diameter of the high pressure passages HPD may be generally equal, or alternatively, the width of the annular groove may be larger than the diameter of the high pressure passages 44.

When the spring cage of the fuel injector (not shown) is attached to the injector nozzle 10, fuel emitted from the spring cage is received in the annular groove 40. The annular groove 40 distributes fuel in generally equal amounts to the inlets 42 of the plurality of high pressure passages 44. An annular lip 46 is disposed between the valve passage 28 and the annular groove 40 to sealingly separate the valve passage from the annular groove, which receives the fuel.

The high pressure passages 44 are disposed generally concentrically about the centerline C of the injector nozzle 10. Extending generally parallel to the valve passage 28, the high pressure passages 44 may have a diameter HPD of about 1 mm and a length HPL of about 13 mm, however other dimensions are possible. It is possible that the pressure passages 44 can extend at an angle with respect to the valve passage 28, or that the pressure passages can be non-linear. The high pressure passage 44 and the valve passage 28 fluidly communicate at the junction chamber 34, which is part of the interior passage 36 that communicates fuel from the high pressure passages to the nozzle tip 24.

Operation of the fuel injector nozzle 10 is such that the rising delivery pressure of the fuel from the high pressure passages 44 acts upon the valve tip (not shown) until a spring preload (not shown) on the valve is overcome. The delivery pressure acts on the tip of the valve so that the valve rapidly opens and fuel is sprayed from the nozzle tip 24 until the pressure falls and the spring loading returns the valve to its seating.

A wall 48 defines the high pressure passage 44 and separates the high pressure passages from the valve passage 28. The wall 48 longitudinally extends from the top surface 12 of the housing 16. A distal end 50 of the wall 48 permits the high pressure passage 44 to fluidly communicate with the junction chamber 34.

In conventional injector nozzles 10, nozzle failure can occur at the wall 48. To reduce the occurrence of nozzle 10 failure at the wall 48, the thickness of the wall is increased to increase the strength of the wall to thereby increase the pressure capability of the injector nozzle 10. Assuming that the high pressure passages 44 have a fixed radial location relative to the centerline C of the injector nozzle 10 to cooperate with the adjoining spring cage (not shown), as the diameter of the high pressure passages HPD decreases, the thickness of the wall WT increases. In the injector nozzle 10, the thickness of the wall WT is about 1 mm, however other thicknesses are contemplated. In the injector nozzle 10, the thickness is at least about 1 mm or more, and the diameter of the high pressure passages HPD is about 1 mm or less.

Increasing the thickness WT of the wall 48 allows the pressure capability of the injector nozzle 10 to be increased. Currently, the conventional nozzle 10 pressures are limited to a maximum of about 2500 bar. With the increased wall thickness WT, the pressure at the high pressure passages 44 can exceed 3000 bar, which allows higher injection pressures, which in turn improves fuel economy and reduces emissions.

Although the embodiment of FIGS. 1-2 has three high pressure passages 44 disposed about 120-degrees apart, it should be appreciated that any plurality of high pressure passages are possible. Further, any diameter of high pressure passages is possible. As the number of high pressure passages 44 increases, the diameter HPD of each high pressure passage can be reduced to maintain the same flow rate. Depending on the number of high pressure passages 44, and the diameters HPD of the high pressure passages 44, the combined flow rate capacity can be increased, decreased, or equal to the flow rate of a single high pressure passage.

What is claimed is:

1. A nozzle for a fuel injector of an engine, comprising:

a generally cylindrical housing defining a valve passage disposed generally longitudinally along the centerline of the housing and extending from a top surface of the housing;

an annular groove disposed in the top surface of the housing and concentrically disposed about the valve passage;

a plurality of inlets disposed in the annular groove, the inlets being in upstream fluid communication with a plurality of discrete high pressure passages disposed in the annular groove, wherein the high pressure passages fluidly communicate with the valve passage at a junction chamber; and a nozzle tip in fluid communication with the junction chamber.

2. The nozzle of claim 1 wherein the housing has a first portion that is generally cylindrical and has a first diameter, and a second portion that is generally cylindrical and has a second diameter, wherein the first diameter is larger than the second diameter, wherein the plurality of high pressure passages are disposed in the first portion only.

3. The nozzle of claim 2 wherein the junction chamber forms part of an interior passage of the housing, wherein the interior passage extends generally longitudinally from the junction chamber, within a shaft of the second portion, and to the nozzle tip.

4. The nozzle of claim 1 wherein the plurality of high pressure passages comprises three high pressure passages disposed about 120-degrees apart.

5. The nozzle of claim 1 wherein the groove has a depth of about 0.5 mm into the top surface towards the nozzle tip.

6. The nozzle of claim 1 wherein an annular lip is disposed between the valve passage and the annular groove to sealingly separate the valve passage from the annular groove.

7. The nozzle of claim 1 wherein the high pressure passages have a diameter of about 1 mm or less.

8. The nozzle of claim 1 further comprising a wall separating the high pressure passage from the valve passage, wherein the wall defines the high pressure passage having a constant diameter along the length of the high pressure passage from the inlet to the junction chamber.

9. The nozzle of claim 8 further comprising a distal end of the wall, wherein the distal end permits the high pressure passage to fluidly communicate with the junction chamber.

10. The nozzle of claim 8 wherein the wall has a thickness of at least about 1 mm.

11. A method of emitting fuel from a nozzle of a fuel injector, comprising the steps of:

providing a housing having a valve passage disposed generally longitudinally along the housing and extending from a top surface of the housing;

introducing fuel into a plurality of discrete high pressure passages concentrically disposed about the valve passage in the housing;

sealing the high pressure passages from the valve passage at the top surface; separating the high pressure passage from the valve passage with a wall that longitudinally extends from the top surface of the housing;

fluidly communicating fuel from the plurality of discrete high pressure passages with the valve passage at a junction chamber; and fluidly communicating fuel from the junction chamber to the nozzle tip.

12. The method of claim 11 further comprising the step of providing the wall with a thickness of at least about 1 mm.

13. The method of claim 11 further comprising the step of locating inlets to the plurality of high pressure passages in an annular groove disposed in the top surface of the housing and concentrically disposed about the valve passage.

14. The method of claim 13 further comprising the step of providing an annular lip between the valve passage and the annular groove to sealingly separate the valve passage from the annular groove.

15. A nozzle for a fuel injector of an engine, comprising:

a housing having a first portion that is generally cylindrical and has a first diameter, and a second portion that is generally cylindrical and has a second diameter, wherein the first diameter is larger than the second diameter, wherein the first portion is upstream of the second portion in the direction of fuel injection;

a valve passage disposed generally longitudinally along the centerline of the housing and extending from a top surface of the first portion of the housing;

an annular groove disposed in the top surface of the first portion of the housing and concentrically disposed about the valve passage;

an annular lip disposed in the top surface of the housing and concentrically disposed about the centerline of the housing between the valve passage and the annular groove;

a plurality of discrete high pressure passages in downstream fluid communication with the annular groove, wherein the high pressure passages are generally parallel to the valve passage and separated by a wall, wherein the plurality of high pressure passages fluidly communicate with the valve passage at a junction chamber located in the first portion of the housing; and a nozzle tip in fluid communication with the junction chamber.

16. The nozzle of claim 15 wherein the high pressure passages have a constant diameter along the length of the high pressure passages from the annular groove to the junction chamber.

17. The nozzle of claim 15 wherein the wall has a thickness of at least about 1 mm.

18. The nozzle of claim 15 wherein the pressure at the high pressure passages exceeds 3000 bar.

19. The nozzle of claim 15 further comprising a distal end of the wall, wherein the distal end permits the high pressure passage to fluidly communicate with the junction chamber.

20. The nozzle of claim 15 wherein the high pressure passages are disposed in the first portion.

* * * * *